US006722609B2

(12) United States Patent
Linick

(10) Patent No.: US 6,722,609 B2
(45) **Date of Patent: *Apr. 20, 2004**

(54) IMPULSE MOTOR AND APPARATUS TO IMPROVE TRAJECTORY CORRECTABLE MUNITIONS INCLUDING CANNON LAUNCHED MUNITIONS, GLIDE BOMBS, MISSILES, ROCKETS AND THE LIKE

(76) Inventor: James M. Linick, 7855 Vizcaya Way, Naples, FL (US) 34108

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/023,118

(22) Filed: Feb. 13, 1998

(65) Prior Publication Data

US 2001/0015396 A1 Aug. 23, 2001

(51) Int. Cl.[7] ..... F42B 15/01
(52) U.S. Cl. ..... 244/3.21; 244/3.22; 244/3.1
(58) Field of Search ..... 102/384, 476; 244/3.1, 3.11, 3.21, 3.22

(56) References Cited

U.S. PATENT DOCUMENTS

| | | | | | |
|---|---|---|---|---|---|
| 3,398,916 | A | * | 8/1968 | Van Vyve | 244/3.22 |
| 3,843,076 | A | | 10/1974 | King et al. | 244/3.22 |
| 3,860,199 | A | | 1/1975 | Dunne | 244/3.13 |
| 4,176,814 | A | | 12/1979 | Albrektsson et al. | 244/3.21 |
| 4,408,735 | A | | 10/1983 | Metz | 244/3.22 |
| 4,492,166 | A | | 1/1985 | Purcell | 244/3.22 |
| 4,762,293 | A | | 8/1988 | Waddington | 244/3.22 |
| 4,928,906 | A | * | 5/1990 | Sturm | 244/3.22 |
| 4,951,901 | A | * | 8/1990 | Dunne | 244/3.23 |
| 5,054,712 | A | | 10/1991 | Bar et al. | 244/3.22 |
| 5,078,117 | A | * | 1/1992 | Cover | 102/440 |
| 5,102,065 | A | | 4/1992 | Couderc et al. | 244/3.11 |
| 5,123,612 | A | | 6/1992 | Labroche et al. | 244/3.22 |
| 5,131,602 | A | * | 7/1992 | Linick | 244/3.14 |
| 5,238,204 | A | | 8/1993 | Metz | 244/3.22 |
| 5,425,514 | A | * | 6/1995 | Grosso | 244/3.22 |
| 5,647,558 | A | * | 7/1997 | Linick | 244/3.21 |
| 5,695,152 | A | | 12/1997 | Levy | 244/3.13 |

FOREIGN PATENT DOCUMENTS

| | | | | |
|---|---|---|---|---|
| GB | 2149066 | * | 6/1985 | 102/476 |

* cited by examiner

*Primary Examiner*—Harold J. Tudor
(74) *Attorney, Agent, or Firm*—Hunton & Williams LLP

(57) ABSTRACT

An device for correcting the in-flight trajectory of a munition consists of an impulse motor assembly body. The slug or multiple slugs and propellant(s) are located within the impulse motor assembly body. When a trajectory correction is desired and required, the individual impulse motor propellants are activated and fired, and the slug or multiple slugs are propelled out of the in-flight munition at a specific time and a specific angle on or near the gravimetric center of gravity of the in-flight munition. The reactive forces created by the explosion of the(se) heavy metal slugs does, by equal and opposite reaction, create a corrective vector and thereby does cause a correction in the trajectory of the in-flight munition.

32 Claims, 2 Drawing Sheets

IMPULSE MOTOR AND APPARATUS TO IMPROVE TRAJECTORY CORRECTABLE MUNITIONS INCLUDING CANNON LAUNCHED MUNITIONS, GLIDE BOMBS, MISSILES, ROCKETS AND THE LIKE

FIELD OF THE INVENTION

This invention is related to the field of munitions, and more particularly toward in-flight corrections of these munitions.

BACKGROUND OF THE INVENTION

There are known methods of correcting the trajectory of in-flight munitions. One such method is described in U.S. Pat. No. 5,131,602, entitled "Apparatus for Remote Guidance of Cannon-Launched Projectiles." Another method is described in U.S. Pat. No. 5,647,558, entitled "Method and Apparatus for Radial Thrust Trajectory Correction of a Ballistic Projectile," issued to the present inventor.

One known method of correcting the trajectory of munitions in-flight is with aerodynamic control surfaces. However, a fairly stable platform is essential for this method, and a spinning platform would make in flight direct control via this method extremely difficult. Further, such control surfaces often have a limited effect in the thin ambient air encountered at high altitudes.

Another known method uses impulse motors or rockets, usually acting nearly through the gravimetric center of gravity of the munitions in flight, perpendicular to the longitudinal axis of such a munition(s), and angularly oriented such that the equal and opposite reaction will create the desired correction. In this instance, commonly used apparatus to achieve trajectory correction consists of an impulse motor or rocket, or a series of impulse motors or rockets that may be fired once, or more than once, to produce the desired correction to the trajectory of the munition(s), in question or at least a portion of that correction thus improving the accuracy and lethality of the munition(s).

In this method, the impulse means generally consists of a form of propellant in solid, granular, liquid or gaseous form. The propellant is converted from a more solid form to a more gaseous form, which greatly increases it material volume. This volumetric explosion creates an equal and opposite reaction to effect the in-flight trajectory correction.

The propellant requires a particular means of operational apparatus and containment, including the appropriate nozzles, internal reactive structures and the like. Such apparatus and containment means, including all those items well known in the art, utilize valuable internal pay load volume. This volume utilization is most ideally used to contain the munitions lethality means, including submunitions and various lethal charges.

As an introduction to this field of invention, it is useful to understand some of the mathematical principles involved. In one hypothetical example, an in-flight munition, with a mass of 50 kg and traveling at a speed of 200 m/s, is 5000 m from the desired target. In this example, it has been determined, by some means (via on-board INS, global positioning system, ground based active or passive radar, or some other means), that a correction of 1000 m is required.

D=5000 m=distance from target

Dc=1000 m=correction distance

V=200 m/s=velocity $D/D_c$=0.2 M=50 kg $V_c$=transverse velocity correction=$V(D_c/D)$=40 m/s $E_1$=energy to achieve trajectory correction=$V_c(M)$=2000 Ns $E_2$=energy content of ammonium perclorate (propellant)=2500 Ns/kg $E_1/E_2$=gravametric quantity of propellant as a function of Ns/kg=800 g Therefore, 800 g of ammonium perclorate and fuel would need to be activated in a specified direction to correct the trajectory of the munition such to hit the desired target.

The material used for these rapidly expanding propellants for trajectory correction of in-flight munition(s) may fall into three main categories as follows:

Gaseous expansion propellant materials of the type described in the hypothetical example above.

Deflagration materials, which could be considered as a muted or toned down explosive, could also be used. This material can possess orders of magnitude more available energy per volumetric unit than the gaseous propellant as described in the example above. Therefore, less volume would be required within the in-flight munition(s) to effect the same reaction. However, one drawback is the size of the containment apparatus and the reactive structures and other required apparatus to support such deflagration materials, with their massive forces of expansion. Such drawbacks may very well outweigh the obvious benefits of deflagration materials.

Detonation materials could also be used in lieu of ordinary propellants or deflagration materials. Detonation materials in fact describe explosives, and can increase the force provided exponentially, as opposed to ordinary propellants and even deflagration materials.

However, the use of deflagration and detonation materials is difficult to control and may very well destroy the munition in-flight rather than correct the trajectory of such flights.

These and other drawbacks exist.

OBJECTS OF THE INVENTION

An object of the invention is to overcome these and other drawbacks in existing devices.

It is an object of the invention to affect the necessary munition(s) correction while in-flight, resulting in increased accuracy and utilization of a minimum of internal munitions volume.

It is another object of the invention to decrease the volume occupied by the trajectory correction means and apparatus, and subsequently increase the volume available for on board lethal cargo payload of all sorts, thereby offering increased accuracy together with substantially increased lethality.

It is another object of the invention as further described herein to utilize the vastly increased power of deflagration or detonation materials, while maintaining impulse control, without destroying the munition whose trajectory is being corrected, and without increasing the trajectory correctable munition(s) cost or complexity.

It is another object of the invention to create trajectory correctable munitions whose trajectory correction means utilize substantially less internal munitions volume than munitions corrected with ordinary propellants as described in the example in the Background of the Invention, with the result being substantially increased lethality on target with no increased cost, while still providing at least a 50% to 95% improved cost to kill ratio, and a vastly decreased logistical tail because less munitions, guns, personnel and other military equipment will be required to accomplish the same mission without the benefits provided by this invention.

It is another object of the invention to provide an in-flight trajectory correction apparatus, wherein a slug is propelled away from a munition at a desired speed and direction to correct the trajectory of the invention.

It is another object of the invention to construct the slug of a heavy metal, such as depleted uranium, and be propelled by a deflagration material or a detonation material.

SUMMARY OF THE INVENTION

To accomplish these and other objects of the invention, improved apparatus and means for trajectory correction are disclosed.

An device for correcting the in-flight trajectory of a munition consists of an impulse motor assembly body. The slug and propellant are located within the impulse motor assembly body. In one preferred embodiment, the slug is made of a heavy metal, such as depleted uranium, while the propellant is made of a deflagration material or detonation material.

When a trajectory correction of the munition is desired, the propellant is activated and the slug is shot out of the munition. This force causes a correction in the trajectory of the munition.

DETAILED DESCRIPTION OF ONE PREFERRED EMBODIMENT

Figure 1:
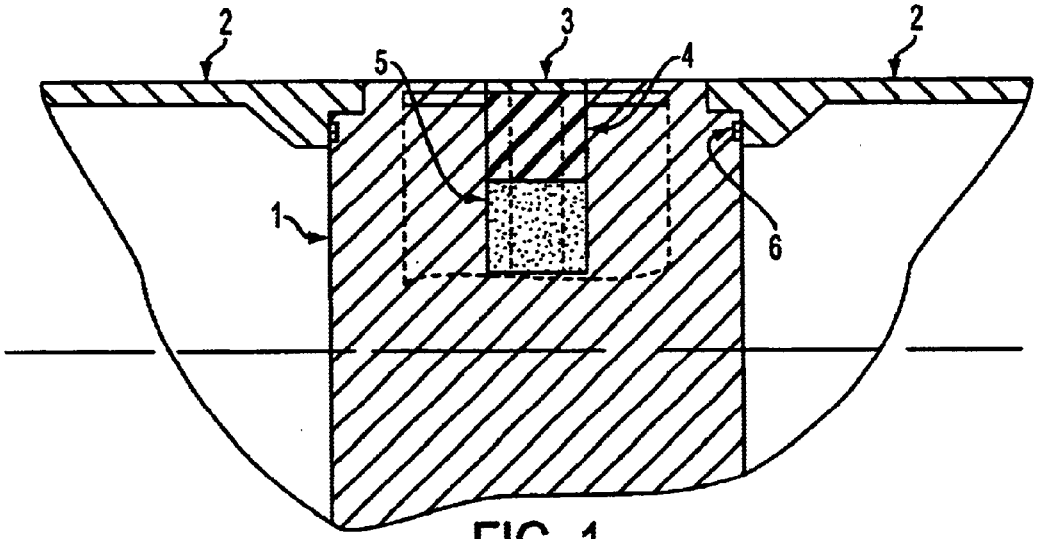
FIG. 1 is a representational cut away of a munition showing the structure of the impulse motor.

FIG. 1 illustrates one preferred embodiment of the invention. An impulse motor assembly body 1 is located within the motor housing 2 of a munition. The impulse motor assembly body 1 includes a slug 4, a slug conformal cap 3, and a propellant 5 for propelling the slug 4 outward and away from the munition. The assembly body 1 is made of a strong material with some degree of malleability, such as any number of steel alloys or titanium alloys. In one embodiment, the material used in the barrel of a firearm is used. The slug may be made of a heavy metal, and in one preferred embodiment, such slugs 4 could be depleted uranium (DU) or tungston having an exponentially greater reactive mass than the reactive mass of the expanding gas alone. A heavy metal is a metal whose specific gravity is approximately 5.0 or higher. The slug conformal cap 3 serves to environmentally seal the slugs 4, as well as ensure an aerodynamic and conformal exterior shape for the munition(s) body. The propellant 5 may be a compressed gas, a deflagration material, a detonation material, or some other type of material which could propel a slug 4. In one preferred embodiment, squib rings 6 are located in an annular fashion around the fore and aft flanges of the Impulse Motor Assembly and will serve to separate the fore and aft sections of the round cargo holds from the Impulse Motor Assembly, thus facilitating the ejection and distribution of the lethal cargo.

The principle of this invention then is to deploy, not just expanding gas from an orifice via an explosion, whatever the explosion or the force, but to additionally deploy heavy metal slugs 4 propelled by the expanding and/or explosive material 5. This allows such propellant material to be smaller in quantity, and, therefore, more controllable. In a preferred embodiment, the slugs 4 are launched at an angle of 90° to the longitudinal axis of the munition, and very near the munition's gravimetric center of gravity. It can be seen that if a sufficiently heavy metal slug(s) 4 can be launched at a sufficient velocity along a desired transverse vector, then the result will be an appropriate reaction necessary to correct the trajectory of the in-flight munition(s).

The shape of the slug 4 is designed to allow the most slugs (slug mass) within the impulse motor assembly. Thus, the size, shape, and distribution pattern of the slugs 4 should be designed so as not to interfere with another, as well as allow sufficient wall material between each slug to prevent sympathetic explosions from one slug to another. While the actual design would utilize a series of minimum/maximum equations vs. available volume, the slug will probably be, for a variety of cost and machining simplicity reasons, a cylinder.

Figure 1A:
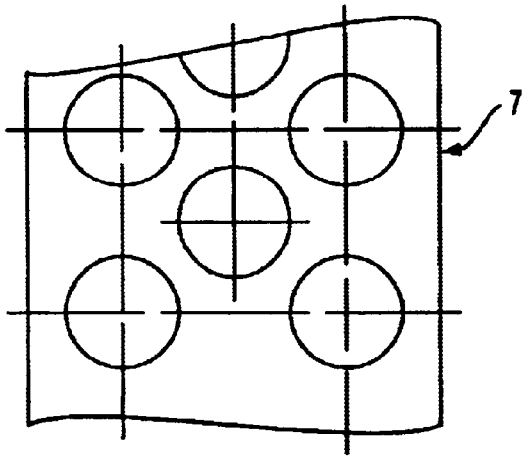
FIG. 1*a* is a representational outer expanded view of the munition showing the impulse motor.

FIG. 1*a* illustrates an expanded plane view of the exterior surface of the Impulse Motor Assembly. An Impulse Motor Assembly body is shown with multiple impulse motors in one type of configuration. A control mechanism (not shown) connected to the impulse motor assembly bodies 1 (i.e., on-board computer and associated safe/arm subassembly and possibly (though not necessarily), a receiver and antenna for the reception of ground up-link signals, etc.) controls which impulse motor assembly bodies 1 will be activated and propel a slug 4 outward. Providing multiple impulse motors within the assembly body 1 around the periphery of the munition allows for more complete control of the trajectory corrections, by allowing multiple slug(s) 4 to be propelled in the necessary direction during one or more rotations and at one or more instances in time to correct the trajectory of the in-flight munition.

Figure 2:
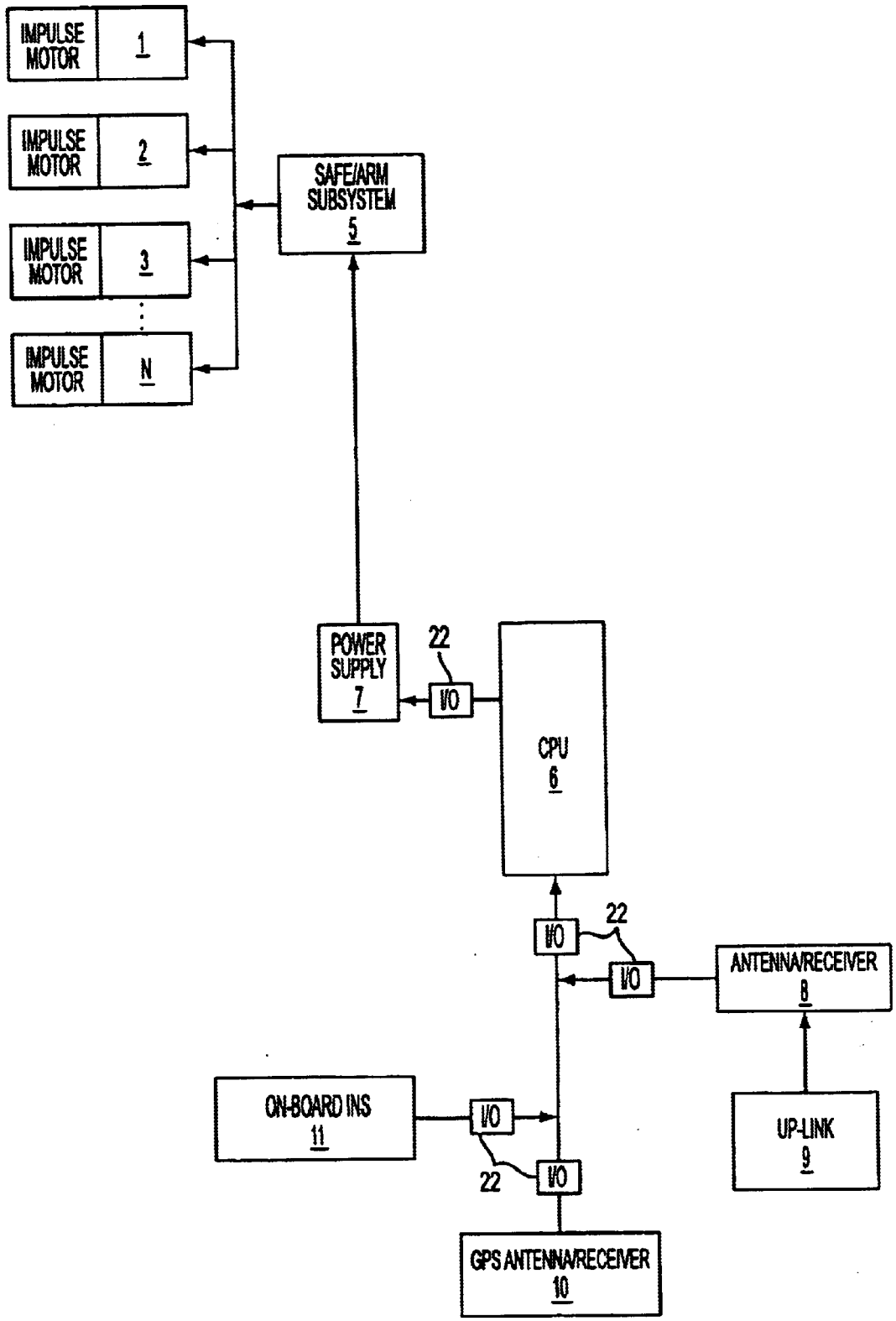
FIG. 2 is a block diagram of the Impulse Motor Subsystem Functions.

FIG. 2 illustrates a block diagram of the impulse motor subsystem functions. In one embodiment, a safe/arm subsystem 15 is attached to N impulse motors 11-N. The safe/arm subsystem 15 is controlled by a central round CPU 16 through a primary central power supply 17. A ground computer and up-link 19 sends a signal to an antenna/receiver 18. An on-board GPS (Global Positioning System) antenna and receiver 20, and/or an on-board INS (IMU) 21, or an uplink signal from the ground computer 19 direct the primary central CPU 16 to fire the appropriate impulse motor(s) 11-N. The onboard INS (IMU) may be preprogrammed on the ground. Each element of the system may be operatively connected, such as through an input/output device 22.

Using this preferred embodiment in the first example, an in-flight munition could have the capability to launch 12 or more DU slugs, each with, for example, a diameter and length of 2.5 cm.

The mass of each slug=236 gm 236 (12 slugs)=2.84 kg 50 kg (mass of original munitions)/2.84 kg (mass of 12 slugs of DU)=17.6

17.6 (original lateral velocity required to effect correction desired=40 m/s)=704 m/s slug velocity A lower slug(s) velocity will produce less correction, unless the correction is done at a proportionately greater range from impact. However, increased slug mass and/or slug quantity can produce the same correction even though the slug launch velocity is decreased.

DU slugs, sub-munitions and pellets, and other DU shrapnel materials and the like are often launched at velocities approaching 2000 m/s or greater. Velocities in the hundreds of meters per second are simply accomplished and completely practical. The required deflagration or detonation materials necessary to launch such slugs at these speeds are well known in the art of weapon construction, particularly devices that explosively launch slugs of heavy metal.

The embodiment above could, for example, be used as the trajectory correction means for 155 mm cannon launched projectile munitions. With this invention, for instance, a trajectory correctable 155 mm round could carry two sidarm submunitions, or, alternatively, almost double the quantity of bomblets, rather than only one such sidearm submunition or less bomblets than when using an ordinary means of trajectory correction.

The foregoing is not intended to limit the scope of the invention, but to merely illustrate some of the preferred embodiments of the invention. The invention is only limited by the claims attached hereto.

What is claimed is:

1. A munition for hitting a ground based target, the munition having an apparatus to correct the munition trajectory in-flight, the apparatus comprising:

a device for propelling a plurality of masses away from the munition in a predetermined direction at a predetermined velocity, wherein the plurality of masses can be propelled at any time during the trajectory of the munition; and a device for determining the location of the munition relative to the ground based target for determining the time to propel the plurality of masses without receiving instructions from the ground.

2. The munition of claim 1, wherein the device for propelling comprises an impulse motor assembly, with a plurality of impulse motors incorporated within a body of the impulse motor assembly.

3. The munition of claim 1, wherein the device for propelling comprises propellants which are activated to propel the plurality of masses.

4. The munition of claim 3, wherein the propellants are a deflagration material.

5. The munition of claim 3, wherein the propellants are a detonation material.

6. The munition of claim 3, wherein the propellants are a compressed gas.

7. The munition of claim 3, wherein the masses are slugs and further wherein the mass of the slug and its respective propellant have exponentially greater reactive mass than the propellant alone.

8. The munition of claim 1, wherein the plurality of masses are slugs fired and thus launched according to a prescribed pattern.

9. The munition of claim 6, wherein each of the masses comprises a slug made of a heavy metal.

10. The munition of claim 7, wherein the slugs comprise a heavy metal, wherein the heavy metal is one of the group consisting of depleted uranium and tungsten.

11. A munition for hitting a ground based target, the munition having an apparatus to correct the munition trajectory in-flight, the apparatus comprising:

a device for propelling a plurality of masses away from the munition in a predetermined direction at a predetermined velocity, the device including an impulse motor assembly, with a plurality of impulse motors radially incorporated within a body of the impulse motor assembly, wherein the plurality of masses can be propelled at any time during the trajectory of the munition; and a device for determining the time to propel the plurality of masses without receiving instructions from the ground.

12. The munition of claim 11, wherein each of the plurality of impulse motors includes a propellant which is activated to propel a mass.

13. The munition of claim 12, wherein the plurality of masses are made of a heavy metal.

14. The munition of claim 11, wherein each of the plurality of masses is a slug, and wherein the plurality of slugs are launched according to a prescribed pattern.

15. The munition of claim 14, wherein each of the slugs is made of a heavy metal, and wherein the heavy metal is one of the group consisting of depleted uranium and tungsten.

16. The munition of claim 14, wherein each of the plurality of impulse motors includes a propellant and a slug, and wherein the mass of the slug and its respective propellant have an exponentially greater reactive mass than the propellant alone.

17. A munition for hitting a ground based target, the munition having an apparatus to correct the munition trajectory in-flight, the apparatus comprising:

a device for propelling a plurality of masses away from the munition in a predetermined direction at a predetermined velocity, wherein the plurality of masses can be propelled at any time during the trajectory of the munition, with a plurality of impulse motors radially incorporated within a body of the impulse motor assembly;

each of the plurality of impulse motors includes a propellant which is activated to propel a mass;

each of the plurality of masses is a slug;

the plurality of slugs are launched according to a prescribed pattern; and a device for determining the time to propel the plurality of masses without receiving instructions from the ground.

18. The munition of claim 17, wherein the plurality of masses are made of a heavy metal, wherein the heavy metal is one of the group consisting of depleted uranium and tungsten.

19. The munition of claim 17, wherein the mass of the slug and its respective propellant have an exponentially greater reactive mass than the propellant alone.

20. The munition of claim 17, wherein the propellants are one of the group consisting of a deflagration material, a detonation material, and a compressed gas.

21. A munition for hitting a ground based target, the munition having an apparatus to correct the munition trajectory in-flight, the apparatus comprising:

a device for propelling a plurality of masses away from the munition in a predetermined direction at a predetermined velocity, wherein the plurality of masses can be propelled at any time during the trajectory of the munition, and wherein the device includes an impulse motor assembly, with a plurality of impulse motors radially incorporated within a body of the impulse motor assembly;

each of the plurality of impulse motors includes a propellant which is activated to propel a mass;

each of the plurality of masses is a slug, where the slugs are made of a heavy metal having a density between approximately the density of depleted uranium and approximately the density of tungsten, and where the mass of the slug and its respective propellant has an exponentially greater reactive mass than the propellant alone;

the plurality of slugs are launched according to a prescribed pattern; and a device for determining the time to propel the plurality of masses without receiving instructions from the ground.

22. The munition of claim 21, wherein the propellants are one of the group consisting of a deflagration material, a detonation material, and a compressed gas.

23. A munition for hitting a ground based target, the munition having an apparatus to correct the munition trajectory in-flight, the apparatus comprising:

a device for propelling a plurality of masses away from the munition in a predetermined direction at a predetermined velocity, wherein the plurality of masses can be propelled at any time during the trajectory of the munition, and where the masses are slugs made of a heavy metal having a density between approximately the density of depleted uranium and approximately the density of tungsten; and a device for determining the location of the munition relative to the ground based target for determining the time to propel the plurality of masses without receiving instructions from the ground.

24. The munition of claim 23, wherein the device for propelling comprises an impulse motor assembly, with a plurality of impulse motors incorporated within a body of the impulse motor assembly.

25. The munition of claim 23, wherein the device for propelling comprises a plurality of propellants which are activated to propel the plurality of masses.

26. The munition of claim 25, wherein the propellants are one of the group consisting of a deflagration material, a detonation material, and a compress gas.

27. The munition of claim 25, wherein the mass of the slug and its respective propellant have exponentially greater reactive mass than the propellant alone.

28. The munition of claim 25, wherein the plurality of slugs are launched according to a prescribed pattern.

29. A munition for hitting a ground based target, the munition having an apparatus to correct the munition trajectory in-flight, the apparatus comprising:

a device for propelling a plurality of slugs away from the munition in a predetermined direction at a predetermined velocity, where the plurality of slugs can be propelled at any time during the trajectory of the munition, the device including:

a) an impulse motor assembly;

b) a plurality of impulse motors radially incorporated within a body of the impulse motor assembly; and c) propellants, with each of the plurality of impulse motors having a propellant associated therewith where the mass of the slug and its respective propellant have an exponentially greater reactive mass than the propellant alone; and where the propellant is activated to propel the slug; and a device for determining the time to propel the plurality of slugs without receiving instructions from the ground during the flight of the munition.

30. The munition according to claim 29, further comprising a global position system antenna and receiver functionally connected to the device for determining the time to propel the plurality of slugs.

31. The munition according to claim 29, where the slugs are made of a heavy metal having a density between approximately the density of depleted uranium and approximately the density of tungsten.

32. The munition according to claim 29, wherein the plurality of slugs are launched according to a prescribed pattern.

* * * * *